US012466676B2

(12) United States Patent
De Gaillande

(10) Patent No.: US 12,466,676 B2
(45) Date of Patent: Nov. 11, 2025

(54) SHEET MATERIAL PROCESSING UNIT AND SHEET MATERIAL PROCESSING MACHINE

(71) Applicant: BOBST MEX SA, Mex (CH)

(72) Inventor: Christophe De Gaillande, Les Monts-de-Corsier (CH)

(73) Assignee: BOBST MEX SA, Mex (CH)

( * ) Notice: Subject to any disclaimer, the term of this patent is extended or adjusted under 35 U.S.C. 154(b) by 512 days.

(21) Appl. No.: 17/999,732

(22) PCT Filed: May 26, 2021

(86) PCT No.: PCT/EP2021/063970
§ 371 (c)(1),
(2) Date: Nov. 23, 2022

(87) PCT Pub. No.: WO2021/249771
PCT Pub. Date: Dec. 16, 2021

(65) Prior Publication Data

US 2023/0234795 A1 Jul. 27, 2023

(30) Foreign Application Priority Data

Jun. 9, 2020 (EP) ..... 20179024

(51) Int. Cl.
*B65H 5/14* (2006.01)
*B65H 5/08* (2006.01)
*B65H 29/00* (2006.01)

(52) U.S. Cl.
CPC ..... *B65H 5/085* (2013.01); *B65H 5/14* (2013.01); *B65H 29/003* (2013.01)

(58) Field of Classification Search
CPC . B65H 5/08; B65H 5/085; B65H 5/14; B65H 29/003; B65H 2405/56;
(Continued)

(56) References Cited

U.S. PATENT DOCUMENTS 5,007,624 A * 4/1991 Chandhoke ..... B65H 39/06 270/58.2
5,975,280 A 11/1999 Cote et al.
(Continued)

FOREIGN PATENT DOCUMENTS

CN 1246100 A 3/2000
DE 102008058070 A1 6/2009
(Continued)

OTHER PUBLICATIONS

Machine translation of EP1044907. (Year: 2000).*

*Primary Examiner* — Thomas A Morrison
(74) *Attorney, Agent, or Firm* — Bookoff McAndrews, PLLC

(57) ABSTRACT

A sheet material processing unit (20, 22, 24) comprises a transport system (32) for transporting sheets (12) or parts thereof from a respective input end (20*i*, 22*i*, 24*i*) to a respective output end (20*o*, 22*o*, 24*o*). A gripper unit (46) is releasably coupled to the transport system (32) and is configured for holding at least a part of one of the sheets (12). Additionally, at least one handover mechanism (47*d*, 47*r*) is provided being configured for decoupling the gripper unit (46) from the transport system (32) and providing the gripper unit (46) to a neighboring sheet material processing unit (20, 22, 24) and/or receiving a gripper unit (46) from a neighboring sheet material processing unit (20, 22, 24) and coupling the received gripper unit (46) to the corresponding transport system (32). Additionally, a sheet material processing machine (10) is presented which comprises at least two such sheet material processing units (20, 22, 24).

14 Claims, 5 Drawing Sheets

Figure 1:
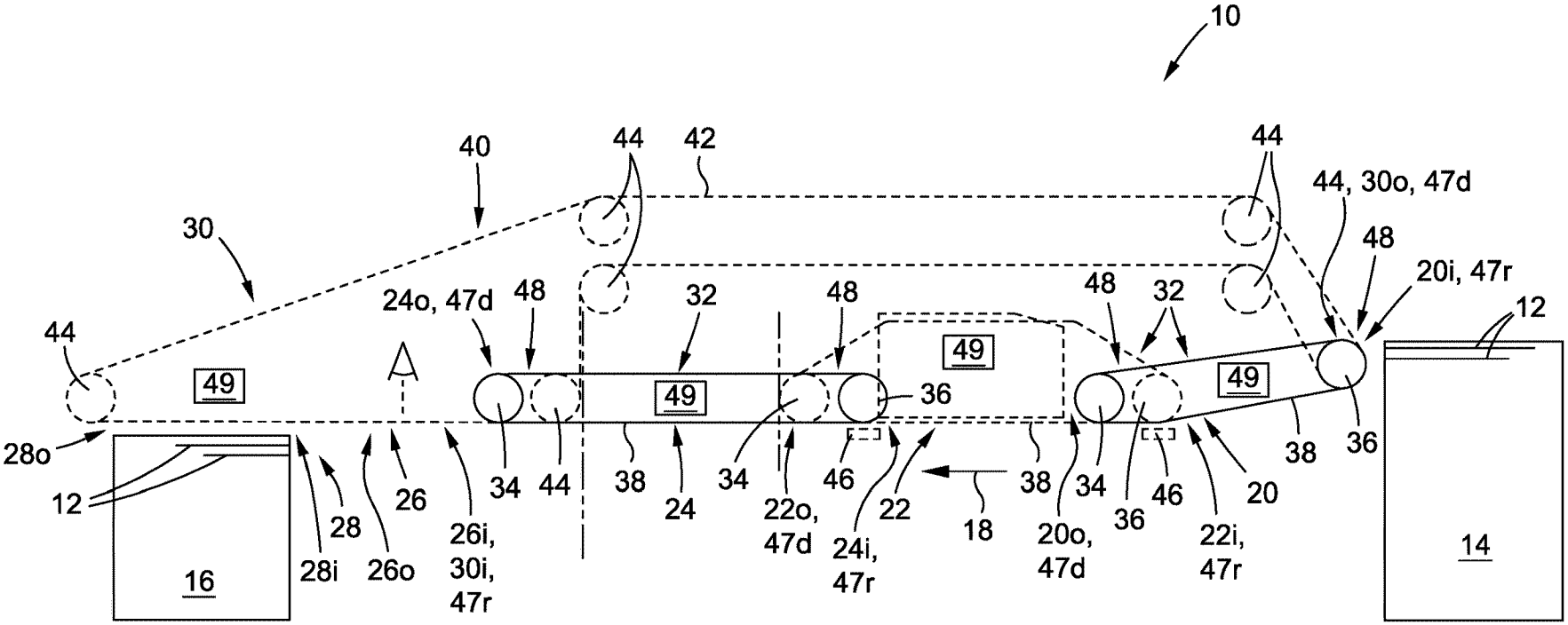

(58) Field of Classification Search
CPC ..... B65H 2405/55; B65H 29/047; B65H 29/045; B65H 29/04; B65H 29/044; B65H 29/042
See application file for complete search history.

(56) References Cited

U.S. PATENT DOCUMENTS

| | | | | |
|---|---|---|---|---|
| 6,270,076 | B1 * | 8/2001 | Reist | B65H 29/60 271/84 |
| 6,302,262 | B1 * | 10/2001 | Maeder | B65H 29/60 198/465.4 |
| 2001/0030105 | A1 | 10/2001 | Maeder | |
| 2008/0210521 | A1 | 9/2008 | Mueller | |
| 2013/0174749 | A1 | 7/2013 | De Gaillande | |

FOREIGN PATENT DOCUMENTS

| | | | |
|---|---|---|---|
| EP | 0804336 | B1 | 7/1998 |
| EP | 1044907 | * | 10/2000 |
| EP | 1044907 | A2 | 10/2000 |
| JP | 11294955 | A | 10/1999 |
| JP | 2000514768 | A | 11/2000 |
| JP | 2000335799 | A | 12/2000 |
| JP | 2001505859 | A | 5/2001 |
| JP | 2014097411 | A | 5/2014 |
| JP | 2017226094 | A | 12/2017 |
| TW | 1515120 | B | 1/2016 |
| WO | 2005105635 | A1 | 11/2005 |
| WO | 2019110237 | A1 | 6/2019 |

* cited by examiner

SHEET MATERIAL PROCESSING UNIT AND SHEET MATERIAL PROCESSING MACHINE

CROSS-REFERENCE TO RELATED APPLICATION(S)

This application is a National Stage Application under 35 U.S.C. § 371 of International Application No. PCT/EP2021/063970, filed May 26, 2021, which claims priority to European Application No. 20179024.3, filed on Jun. 9, 2020, the entireties of which are incorporated herein by reference.

The invention relates to a sheet material processing unit, comprising an input end where sheets to be processed enter the sheet material processing unit, and an output end where at least parts of the sheets leave the sheet material processing unit. The sheet material processing unit according to the invention is especially a paper processing unit, a cardboard processing unit or a flexible material processing unit.

Additionally, the invention relates to a sheet material processing machine comprising at least two such sheet material processing units.

Sheet material processing units and corresponding sheet material processing machines are known in the art.

In this context, the sheet material processing machine is for example a hot-foil-stamping machine. Such a machine comprises sheet material processing units related to hot-foil application by a platen and sheet delivery. Alternatively, the sheet material processing machine is a die-cutting machine comprising sheet material processing units related to cutting, waste ejection and blank separation. The invention however is not limited to these types of machines.

In order to make a sheet material travel through the different units of the machine, a transport system is provided. Often this transport system comprises a chain drive or belt drive substantially extending over all units of the machine. Consequently, a sheet material to be processed is connected to the transport system at an input end of the sheet material processing machine and at least a part of the sheet material released from the transport system at an output end of the sheet material processing machine after having been processed.

Such sheet material processing machines are efficient in performing a certain number of predefined process steps. Modifying the number or the nature of these steps implies profound modifications of the machine.

The problem to be solved by the present invention therefore is to make sheet material processing machines more flexible. Of course, the high level of efficiency and productivity of such machines shall be maintained.

The problem is solved by a sheet material processing unit as mentioned above which comprises a transport system for transporting the sheets or parts thereof from the input end to the output end, and a gripper unit being releasably coupled to the transport system and being configured for holding at least a part of one of the sheets. Additionally, the input end and/or the output end are/is equipped with a handover mechanism being configured for decoupling the gripper unit from the transport system and providing the gripper unit to a neighboring sheet material processing unit and/or receiving a gripper unit from a neighboring sheet material processing unit and coupling the received gripper unit to the corresponding transport system. In contrast to known sheet material processing machines, each sheet material processing unit comprises a proprietary transport system. These transport systems may be selectively interconnected by handover mechanisms. Consequently, such sheet material processing units are self-contained modules which may be freely combined to form a sheet material processing machine. Thus, the number of modules and the corresponding process steps performed by the modules can be easily adapted. Compared to a known transport system of a known sheet material processing machine, the transport system of the sheet material processing unit is smaller and less complex. Additionally, its weight and inertia are reduced. A further advantage lies in the fact that several sheet material processing units may be produced and tested in parallel or separately before being assembled to form a sheet material processing machine.

The basic idea of the invention is to replace known transport systems spanning over all processing units of known sheet material processing machines by smaller transport systems being proprietary to each sheet material processing unit. These transport systems are interconnectable. To this end the corresponding gripper units are releasably connected thereto. Consequently, the gripper units can be handed over from one sheet material processing unit to a neighboring sheet material processing unit.

The fact that the transport system is adapted for transporting sheets or parts thereof and that the gripper unit is configured for holding at least a part of the sheet is due to the situation that a sheet entering the sheet material processing unit may be separated into several parts during its processing. In principle, three alternatives may be imagined. In a first alternative the sheet enters and leaves the sheet material processing unit without being separated into parts. Alternatively, the sheet entering the sheet material processing machine is separated into a first part and a second part during its processing. The first part may correspond to a desired result of the process, e.g. a product or intermediate product, and the second part may be waste. Thus, in a second alternative, the gripper unit may be configured for holding the first part, i.e. the product or intermediate product, wherein in a third alternative the gripper unit may be configured for holding the second part, i.e. the waste. In summary, the sheet material processing unit according to the invention is configured for all mentioned alternatives.

The sheet material processing unit may be adapted for processing sheet material in the form of cardboard, paper, plastic or wood.

The gripper unit may be coupled to the transport system via a clip-on mechanism, especially wherein the transport system comprises one or more male clip elements and the gripper unit comprises one or more corresponding female clip elements. Such a gripper unit may be easily and quickly disconnected from one transport system and connected to another transport system, e.g. the transport system of a neighboring sheet material processing unit. This process may be automated. Furthermore, the clip-on mechanism allows for positioning the gripper on the transport system in a precise and stable manner.

In an alternative the gripper unit is coupled to the transport system via a clamping mechanism, wherein the gripper unit comprises at least one switchable clamp being configured for selectively engaging the transport system of the sheet material processing unit and/or the transport system of a neighboring sheet material processing unit. The switching of the clamp may be performed automatically in that an actuating cam operates the clamping mechanism. This may be performed quickly. Consequently, the clamping mechanism allows for an easy and reliable handover of the gripper units between two neighboring sheet material processing units. In this context, the gripper unit and the transport systems may be configured such that clamping is only possible at designated locations of the transport systems.

Alternatively, the gripper unit and the transport systems may be configured such that the gripper unit may be coupled to the transport systems at any suitable location thereof.

According to an embodiment the transport system comprises a processing section configured for transporting gripper units holding sheets or parts thereof for being processed in a direction from the input end to the output end. Thereby the processing section is associated with a handover mechanism arranged on the input end and being configured for receiving a gripper unit from a neighboring sheet material processing unit and coupling the received gripper unit to the corresponding transport system. Additionally or alternatively the processing section is associated with a handover mechanism arranged on the output end and being configured for decoupling the gripper unit from the transport system and providing the gripper unit to a neighboring sheet material processing unit. Consequently, gripper units carrying sheet material or parts thereof to be processed may arrive at the input end of the sheet material processing unit. The gripper units are then connected to the corresponding transport system via the handover mechanism. Subsequently, the sheet material or parts thereof may undergo one or more process steps performed by the sheet material processing unit. Then the gripper unit and the sheet material or parts thereof will arrive at the output end and will be transferred to a neighboring sheet material processing unit performing subsequent processing steps in that the gripper unit is released from the transport system and connected to the transport system of the neighboring sheet material processing unit. Thus, the sheet material processing unit is a flexible module which can easily be connected with other modules in order to process sheet material.

The sheet material processing unit can be a feeder unit, preferably including a registration module, a platen press unit, especially a hot foil stamping unit or a die-cutting unit, a stripping unit a waste ejection unit, a blank separation unit, a quality control unit, a digital printing unit, a digital embellishment unit, a digital cutting unit, a creasing unit or a delivery unit. Thus the sheet material processing unit can be adapted for performing any kind of processing steps related to sheet material processing.

In a variant the sheet material processing unit is a transition unit being configured for connecting two sheet material processing units being used for processing sheet material. The transport system of the transition unit comprises a transition section configured for transporting gripper units holding sheets or parts thereof in a direction from the input end to the output end. Additionally, the transition section is associated with a handover mechanism arranged on the input end and being configured for receiving a gripper unit from a neighboring sheet material processing unit and coupling the received gripper unit to the corresponding transport system. Moreover, the transition section is associated with a handover mechanism arranged on the output end and being configured for decoupling the gripper unit from the transport system and providing the gripper unit to a neighboring sheet material processing unit. In other words the sheet material processing unit being configured as a transition unit may be used for connecting two sheet material processing units which are used for treating sheet material. The transition unit as such is not configured for performing process steps other than transporting sheets or parts thereof. The purpose of a transition unit is rather to make sheet material processing units compatible, i.e. connect sheet material processing units wherein a handover mechanism at an output end of one of the sheet material processing units may not be directly connectable to a handover mechanism at an input end of another one of the sheet material processing units. If the transition unit is used, a gripper unit may be transferred from one sheet material processing unit to the transition unit and from there to another sheet material processing unit. In this context the handover mechanisms at the input end and the output end of the transition unit may be of different design. Consequently, the transition unit can be used as an adapter unit. Alternatively or additionally, the transition unit may be simply used for bridging a certain distance between two sheet material processing units.

The transport system can also comprise a recirculation section configured for transporting gripper units without sheets in a direction from the output end to the input end. Thereby the recirculation section is associated with a handover mechanism arranged on the output end and being configured for receiving a gripper unit from a neighboring sheet material processing unit and coupling the received gripper unit to the corresponding transport system. Additionally or alternatively the recirculation section is associated with a handover mechanism arranged on the input end and being configured for decoupling the gripper unit from the transport system and providing the gripper unit to a neighboring sheet material processing unit. In other words, the sheet material processing unit is able to recirculate empty gripper units from an output end to an input end thereof. These gripper units may then be used for processing additional sheet material. In doing so, the gripper units circulate in a closed loop. This is efficient in that only a predefined number of gripper units is needed and in that the recirculation is done in a fully automatic manner.

Preferably, the transport system comprises a belt drive or a chain drive, wherein the gripper unit is releasably coupled to a corresponding belt or chain. Belt drives and chain drives have proven to be suitable for sheet material processing units. They are reliable and precise in operation.

The problem is also solved by a sheet material processing machine as mentioned above which comprises at least two neighboring sheet material processing units according to the invention. The sheet material processing units are coupled by a first handover mechanism being provided at an output end of a first sheet material processing unit and being configured for decoupling the gripper unit from the corresponding transport system and providing the gripper unit to a second sheet material processing unit and a second handover mechanism being provided at an input end of the second sheet material processing unit and being configured for receiving the gripper unit from the first sheet material processing unit and coupling the received gripper unit to a corresponding transport system. In this context both of the at least two sheet material processing units may actually perform a process step on the sheet material to be processed. Alternatively, one of the at least two sheet material processing units is a transition unit and only the other one of the at least two sheet material processing units performs a process step. Thus, such a sheet material processing machine is highly flexible in that depending on the process to be performed, sheet material processing units may be easily combined and connected by the corresponding handover mechanisms. It is also possible to eliminate process steps by eliminating the corresponding sheet material processing unit and reconnecting the remaining sheet material processing units by their handover mechanisms.

In a configuration in which one of the at least two sheet material processing units of the sheet material processing machine is a transition unit, preferably a third sheet material processing unit is provided which is configured for performing a process step on the sheet material. The transition unit is advantageously located in between the sheet material processing units performing process steps on the sheet material. In doing so the transition unit may operate as an adapter unit as has already been described before. Consequently, sheet material processing units may be freely and flexibly combined.

The two neighboring sheet material processing units may be coupled by a third handover mechanism being provided at an input end of the second sheet material processing unit and being configured for decoupling the gripper unit from the corresponding transport system and providing the gripper unit to the first sheet material processing unit and by a fourth handover mechanism being provided at an output end of the first sheet material processing unit and being configured for receiving the gripper unit from the second sheet material processing unit and coupling the received gripper unit to a corresponding transport system. This applies to sheet material processing units actually performing process steps and also to sheet material processing units being transition units. Thus, gripper units may be recirculated to an input end of the sheet material processing machine after they have been served for holding sheet material. The gripper units may thus be operated in a closed loop.

Alternatively, a recirculation module may be provided comprising a transport system for transferring gripper units from an output end of the second sheet material processing unit to an input end of the first sheet material processing unit. In this alternative the gripper units are not recirculated via the sheet material processing units but via a separate recirculation module spanning from an output end of the sheet material processing machine to an input end thereof. Thus, the sheet material processing units may be operated as if they were used in an open-loop configuration. Due to the recirculation module, the sheet material processing machine as such may be operated in a closed loop.

Recirculation modules are especially advantageous for sheet material processing units transporting the gripper units with the sheets or parts thereof at a speed variable over time. In this context, the gripper units and corresponding sheets or parts thereof may be regularly accelerated or decelerated. The movement of the gripper units and the corresponding sheets or parts thereof may also be regularly stopped. Such a mode of operation may be called a stop-and-go mode. However, the recirculation modules may operate continuously, i.e. transporting the gripper units and corresponding sheets or parts thereof at substantially constant speed. In this configuration the sheet material processing units experience reduced inertia when accelerating or decelerating gripper units and corresponding sheets or parts thereof since the gripper units being in the course of recirculation are decoupled therefrom. This allows for operating the sheet material processing units at high speed and/or high accelerations. Additionally, high quality process results are assured.

The sheet material processing machine may also comprise a gripper exchange module which may be coupled to a recirculation section of at least one of the sheet material processing units or the recirculation module. The gripper exchange module is configured for withdrawing gripper units from the recirculation section or the recirculation module and/or for feeding gripper units into the recirculation section or the recirculation module. Thus, the gripper exchange module may be used for exchanging gripper units needing to undergo maintenance or needing replacement. Moreover, the gripper exchange module may be used for increasing or decreasing the number of gripper units being used in the sheet material processing machine. Consequently, the gripper exchange module facilitates adaptation of the sheet material processing machine to different jobs needing different numbers of gripper units. The gripper exchange module may operate while sheet material is processed by the sheet material processing machine and especially by the sheet material processing units. Consequently, the gripper exchange module may perform its functions without the need for stopping the process in the sheet material processing machine.

The gripper exchange module may be equipped with an input buffer in which a number of gripper units may be stored. Consequently, gripper units are held available for replacing or complementing the gripper units in the sheet material processing machine. Thus, the replacing or complementing may be performed within a very restricted time frame.

Advantageously, the transport system of the first sheet material processing unit comprises a first transport wheel being arranged at the output end thereof and the transport system of the second sheet material processing unit comprises a second transport wheel being arranged at the input end thereof, wherein the first transport wheel and the second transport wheel are substantially arranged coaxially. In this configuration the handover of the gripper units may be performed quickly in that the first transport wheel actuates a release mechanism disconnecting the gripper unit from the transport system of the first sheet material processing unit and the second transport wheel actuates a locking mechanism connecting the gripper unit to the transport system of the second sheet material processing unit. This solution is also space-saving.

In another embodiment the transport system of the first sheet material processing unit overlaps the transport system of the second sheet material processing unit in a processing direction. The area where the transport system overlap may be called a transition zone. In this area the griper unit will be coupled with the transport system of the second sheet material processing unit and decoupled from the transport system of the first sheet material processing unit. Preferably, the gripper unit will be connected to the transport system of the second sheet material processing unit before it is released from the transport system of the first sheet material processing unit. In doing so, the gripper unit is always in a well defined position.

According to a preferred variant the transport system of the first sheet material processing unit and the transport system of the second sheet material processing unit comprise a control unit respectively such that the transport systems are controllable independently from one another. This allows for example for independent error handling in the respective sheet material processing units. Especially positioning errors of the sheet material to be processed may be easily corrected. Additionally, the independent control units make it possible to combine sheet material processing units relying on different operational speeds. It is also possible to connect sheet material processing unit which operate at constant speed, e.g. feeding or discharging units, with sheet material processing units operating in a stop-and-go-mode, e.g. platen or stripping units. It is noted that for ensuring a smooth transition between two independently controllable sheet material processing units, the sheet material processing units need to be synchronized only during the transition of the gripper unit from one transport system to the neighboring one. For example, if the first unit is operating in a stop-and-go-mode, and the second operates at constant speed, only during the relatively short period of time during which the gripper handed over from one transport system to the neighboring transport system, both transport system need to run at the same speed.

The sheet material processing machine may be a platen press, especially a hot-foil stamping machine, or a die-cutting machine.

Figure 2:
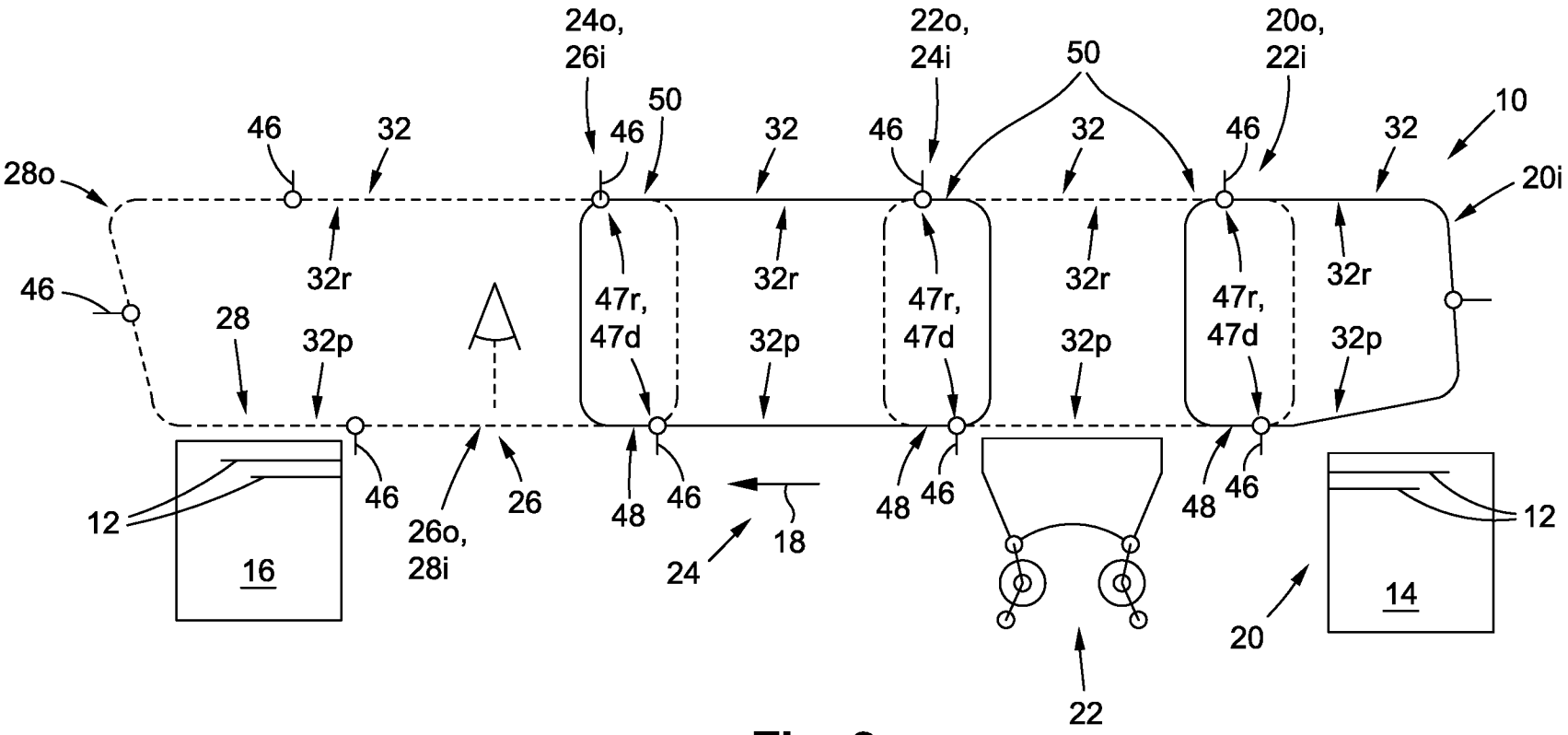
Figure 3:
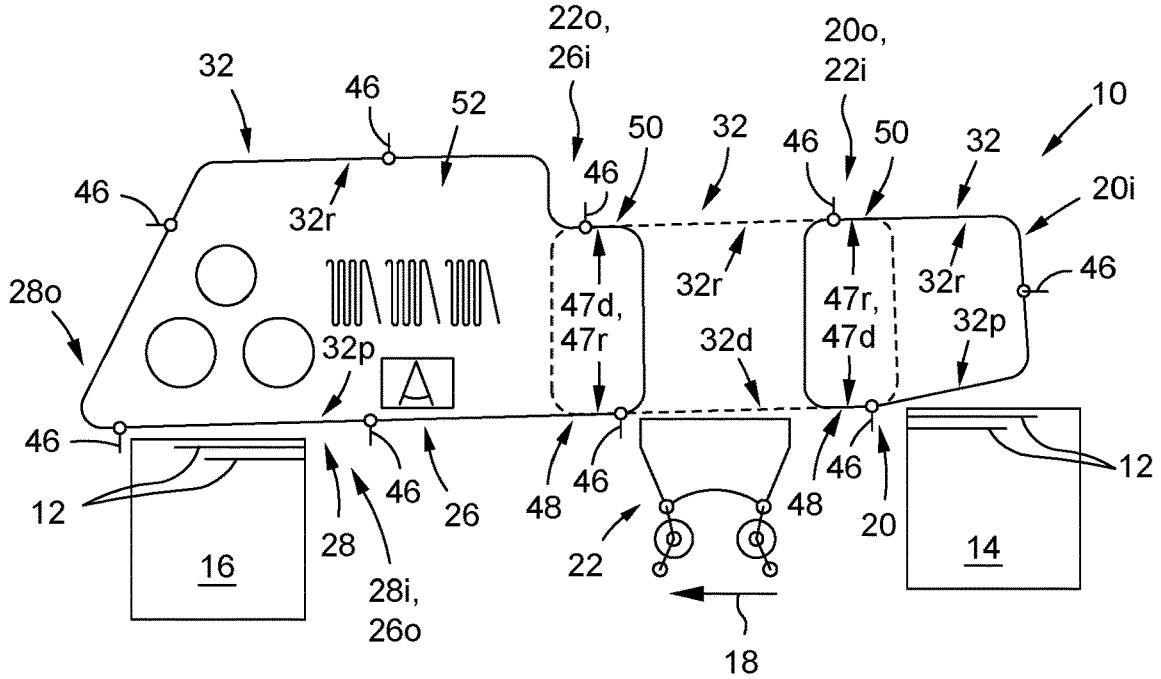
Figure 4:
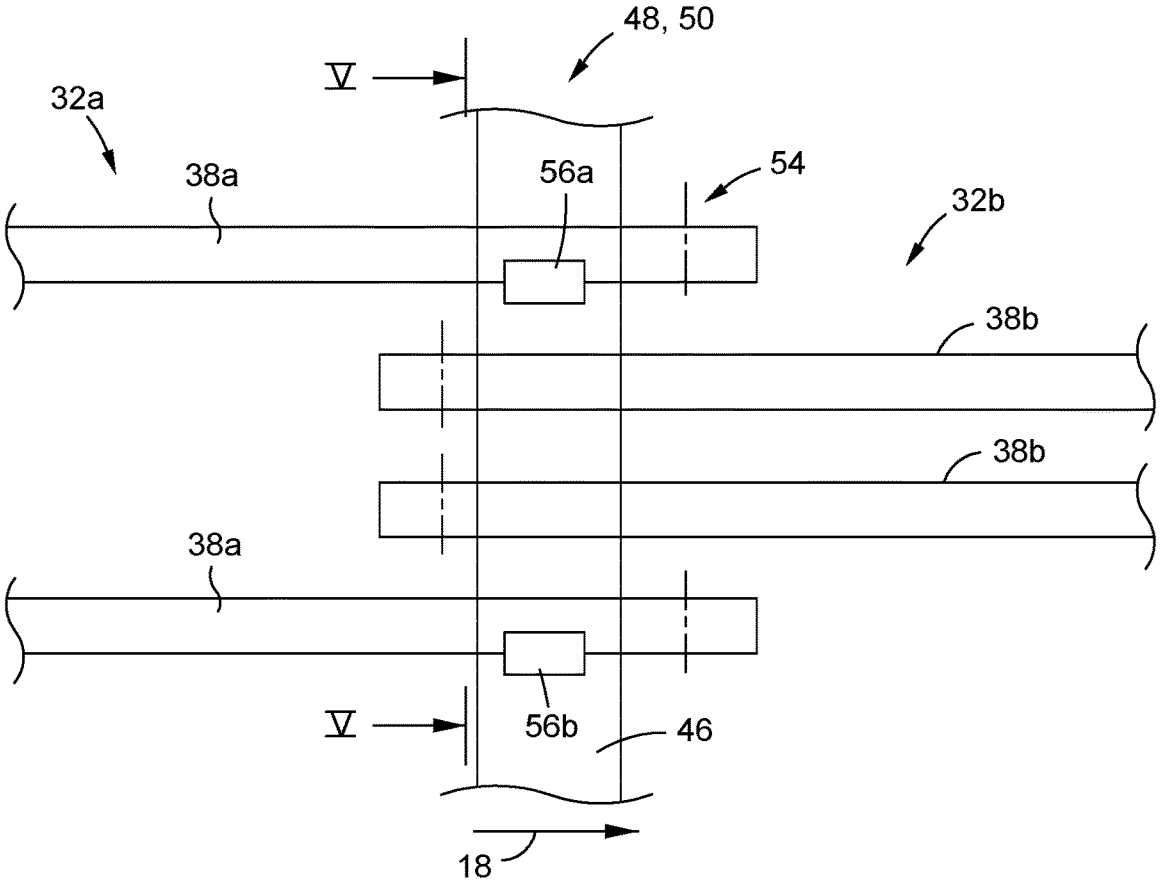

The invention will now be described with reference to the enclosed drawings. In the drawings, FIG. 1 schematically shows a sheet material processing machine according to a first embodiment comprising several sheet material processing units according to the invention, FIG. 2 schematically shows a sheet material processing machine according to a second embodiment comprising several sheet material processing units according to the invention, FIG. 3 schematically shows a sheet material processing machine according to a third embodiment comprising several sheet material processing units according to the invention, FIG. 4 is a detailed view of a transition zone of the sheet material processing machines of FIGS. 1 to 3, FIG. 5 shows a sectional view V-V of FIG. 4, FIG. 6 is a detailed view of an alternative transition zone of the sheet material processing machines of FIGS. 1 to 3, FIG. 7 is a schematic view of a gripper exchange module which can be part of any one of the sheet material processing machines of FIGS. 1 to 3, FIG. 8 schematically shows a sheet material processing machine according to a fourth embodiment comprising three sheet material processing units according to the invention, wherein one thereof is a transition unit, and FIG. 9 is a view of the sheet material processing machine according to FIG. 8 along direction IX in FIG. 8.

FIG. 1 shows a sheet material processing machine 10 according to a first embodiment which is a die-cutting machine.

It is adapted for processing sheets 12 being provided on an entering pile 14 and being placed on an exiting pile 16 after having been processed.

Following a processing direction 18 of the sheets 12 through the sheet material processing machine 10 it comprises a total of five sheet material processing units 20 to 28.

In the present example, sheet material processing unit 20 is a feeder unit, sheet material processing unit 22 is a platen press unit, sheet material processing unit 24 is a stripping unit, sheet material processing unit 26 is a quality control unit and sheet material processing unit 28 is a delivery unit.

In the following, the feeder unit will be designated with reference sign 20, the platen press unit will be designated with reference sign 22, the stripping unit will be designated with reference sign 24, the quality control unit will be designated with reference sign 26 and the delivery unit will be designated with reference sign 28 for the ease of explanation.

Furthermore, a recirculation module 30 is provided.

Each of the sheet material processing units 20 to 28 comprises an input end, respectively designated 20*i*, 22*i*, 24*i*, 26*i*, 28*i*, where sheets 12 to be processed enter the respective sheet material processing unit 20 to 28 and an output end, respectively designated 20*o*, 22*o*, 24*o*, 26*o*, 28*o*, where the sheets 12 leave the respective sheet material processing unit 20 to 28.

The feeder unit 20, the platen press unit 22, and the stripping unit 24 are equipped with a respective transport system 32 for transporting the sheets 12 from the respective input end 20*i*, 22*i*, 24*i* to the respective output end 20*o*, 22*o*, 24*o*.

Each transport system 32 comprises a first transport wheel 34 being arranged at the output end 20*o*, 22*o*, 24*o* of the corresponding sheet material processing unit 20, 22, 24 and a second transport wheel 36 being arranged at the input end 20*i*, 22*i*, 24*i* of the corresponding sheet material processing unit 20, 22, 24.

The transport wheels 34, 36 interact with a belt 38 being driven and/or guided by the respective transport wheels 34, 36.

The recirculation module 30 also comprises a transport system 40 which is equipped with a belt 42 that is driven and/or guided by a plurality of associated transport wheels 44.

In the example shown in FIG. 1 the transport system 40 is a shared transport system in the sense that it is also used for the quality control unit 26 and the delivery unit 28. In other words, the quality control unit 26 and the delivery unit 28 do not have a separate transport system such as the feeder unit 20, the platen press unit 22 and the stripping unit 24.

All transport systems 32 are adapted for transporting sheets 12 from the respective input end 20*i*, 22*i*, 24*i* to the respective output end 20*o*, 22*o*, 24*o*.

Since the sheets 12 do not directly interact with the transport systems 32, 40, gripper units 46 are provided which are adapted for holding the sheet 12.

The gripper units 46 may be coupled to the transport systems 32, 40.

It is to be understood that the number of gripper units 46 used in a specific sheet material processing machine 10 may vary depending on the job to be performed.

In FIG. 1 only two gripper units 46 are shown, which is rather due to the ease of representation than to technical requirements.

The sheets 12 to be processed are gripped by the gripper unit 46 in the feeder unit 20 and released in the delivery unit 28.

The transport system 40 is adapted for transporting gripper units 46 without sheets 12 from the output end 24*o* of the stripping unit 24 to the input end 20*i* of the feeder unit 20.

Consequently, the gripper units 46 are operated in a closed loop.

Therefore, the gripper units 46 need to be transferred from one transport system 32, 40 to a respective neighboring transport system 32, 40.

In order to do so, the gripper units 46 are releasably coupled to the transport systems 32, 40, more precisely to the corresponding belts 38, 42.

Moreover, each of the input ends 20*i*, 22*i* 24*i*, 26*i* comprise a handover mechanism 47*r* being configured for receiving a gripper unit 46 from a neighboring sheet material processing unit 20 to 24 or the recirculation module 30 and coupling the received gripper unit 46 to the respective transport system 32, 40.

In this context, the input end 26*i* of the quality control unit serves as an input end 30*i* of the recirculation module 30.

The output ends 20*o*, 22*o*, 24*o*, 30*o* are equipped with a handover mechanism 47*d* which is configured for decoupling the gripper unit 46 from the respective transport system 32, 40 and providing the gripper unit 46 to a neighboring sheet material processing unit 22 to 24 or the recirculation module 30.

The zones where the handing over of the gripper units 46 happens are called transition zones 48.

In more detail, the feeder unit 20 comprises a handover mechanism 47*d* being provided in the transition zone 48 associated with its output end 20*o* and being configured for decoupling the gripper unit 46 from the transport system 32 and providing the gripper unit 46 to the transport system 32 of the platen press unit 22.

Moreover, the feeder unit 20 comprises a handover mechanism 47*r* being provided in the transition zone 48 associated with its input end 20*i* and being configured for receiving the gripper unit 46 without carrying a sheet 12 from the recirculation module 30 and coupling the received gripper unit 46 to its transport system 32.

Thus, the feeder unit 20 in total comprises two handover mechanisms 47*d*, 47*r*.

The platen press unit 22 comprises a handover mechanism 47*r* being provided in the transition zone 48 associated with its input end 22*i* and being configured for receiving the gripper unit 46 carrying a sheet 12 from the feeder unit 20 and coupling the received gripper unit 46 to its transport system 32.

Additionally, the platen press unit 22 comprises a handover mechanism 47*d* being provided in the transition zone 48 associated with its output end 22*o* and being configured for decoupling the gripper unit 46 from the transport system 32 and providing the gripper unit 46 to the transport system 32 of the stripping unit 24.

Thus, also the platen press unit 22 comprises a total of two handover mechanisms 47*r*, 47*d*.

The same applies to the stripping unit 24 to which the above explanations apply mutatis mutandis.

The transport system 40 of the recirculation module 30, which is also shared by the quality control unit 26 and the delivery unit 28 comprises a handover mechanism 47*r* being provided in the transition zone 48 associated with its input end 26*i*, 30*i* and being configured for receiving the gripper unit 46 carrying a sheet 12 from the stripping unit 24 and coupling the received gripper unit 46 to its transport system 40.

Furthermore, a handover mechanism 47*d* is provided in the transition zone 48 associated with its output end 30*o* and being configured for decoupling the gripper unit 46 from the transport system 40 and providing the gripper unit 46 to the transport system 32 of the feeder unit 20.

Thus, the shared transport system 40 of the recirculation module 30 comprises two handover mechanisms 47*d*, 47*r*.

The handover mechanisms 47*r*, 47*d* and the transition zones 48 will be explained below in connection with FIGS. 4 to 6.

Each of the transport systems 32 of the sheet material processing units 20 to 24 and the transport system 40 of the recirculation module 30 comprises a respective control unit 49.

The control units 49 are adapted for controlling the movement of the respective belt 38, 42. In doing so, a position and a movement of a gripper unit 46 being coupled to the respective belt 38, 42 can be precisely controlled.

The control units 49 are independent from each other and thus make it possible to operate some of the transport systems 32, 40 in a continuous manner, i.e. the corresponding belts 38, 42 travel at a substantially constant speed.

In the example shown this is the case for the feeder unit 20 and the recirculation module 30.

It is also possible to operate other transport systems 32, 40 in a stop-and-go-mode, i.e. the corresponding belts 38, 42 are intermittently accelerated to a predetermined travel speed and then stopped.

In the example of FIG. 1 this is the case for the platen press unit 22 and the stripping unit 24.

In FIG. 2 a sheet material processing machine 10 according to a second embodiment is shown.

In the following only the differences to the sheet material processing machine 10 according to the first embodiment will be explained. Equal or corresponding parts will be designated with the same reference signs.

The sheet material processing machine 10 of FIG. 2 is also a die-cutting machine and comprises a feeder unit 20, a platen press unit 22, a stripping unit 24, a quality control unit 26 and a delivery unit 28.

Again, the sheet material processing units 20 to 24 are equipped with a transport system 32.

In contrast to the first embodiment, no recirculation module is provided. Instead, the quality control unit 26 and the delivery unit 28 share a transport system 32.

The sheet material processing machine 10 according to the second embodiment further differs from the sheet material processing machine 10 according to the first embodiment in that the recirculation of gripper units 46 without sheets 12 takes place via the transport systems 32 of the sheet material processing units 20 to 28.

In this context, the transport systems 32 may be subdivided into a processing section 32*p* and a recirculation section 32*r* respectively.

The processing sections 32*p* are configured for transporting gripper units 46 holding sheets 12 for being processed in a processing direction 18, i.e. from a respective input end 20*i*, 22*i*, 24*i*, 26*i* to a respective output end 20*o*, 22*o*, 24*o*.

The processing sections are associated with respective handover mechanisms 47*r*, 47*d* which are arranged in transit zones 48 and substantially correspond to the handover mechanisms 47*r*, 47*d* as explained with respect to the first embodiment.

The recirculation sections 32*r* are configured for transporting gripper units 46 without sheets 12 in a direction from a respective output end 28*o*, 26*o*, 24*o*, 22*o*, 20*o* to a respective input end 20*i*, 22*i*, 24*i*, 26*i*, 28*i*.

To this end, also the recirculation sections 32*r* are provided with handover mechanisms 47*r*, 47*d* which are arranged in corresponding transit zones 50.

The handover mechanisms 47*r*, 47*d* of the recirculation sections 32*r* substantially correspond to the handover mechanisms 47*r*, 47*d* of the processing sections 32*p* and will be explained in detail in connection with FIGS. 4 to 6 below.

Consequently, the feeder unit 20 comprises a handover mechanism 47*d* being provided in the transition zone 48 associated with its output end 20*o* and being configured for decoupling the gripper unit 46 from the transport system 32 and providing the gripper unit 46 to the transport system 32 of the platen press unit 22.

Additionally, the feeder unit 20 comprises a handover mechanism 47*r* being provided in the transition zone 50 associated with its output end 20*o* and being configured for receiving the gripper unit 46 without carrying a sheet 12 from the platen press unit 22 and coupling the received gripper unit 46 to its transport system 32.

Thus, the feeder unit 20 in total comprises two handover mechanisms 47*d*, 47*r*.

The platen press unit 22 comprises a handover mechanism 47*r* being provided in the transition zone 48 associated with its input end 22*i* and being configured for receiving the gripper unit 46 carrying a sheet 12 from the feeder unit 20 and coupling the received gripper unit 46 to its transport system 32.

Moreover, the platen press unit 22 comprises a handover mechanism 47*d* being provided in the transition zone 48 associated with its output end 22*o* and being configured for decoupling the gripper unit 46 from the transport system 32 and providing the gripper unit 46 to the transport system 32 of the stripping unit 24.

Additionally, platen press unit 22 comprises a handover mechanism 47*r* being provided in the transition zone 50 associated with its output end 22*o* and being configured for receiving the gripper unit 46 not carrying a sheet 12 from the stripping unit 24 and coupling the received gripper unit 46 to its transport system 32.

The platen press unit 22 comprises a further handover mechanism 47*d* being provided in the transition zone 50 associated with its input end 22*i* and being configured for decoupling the gripper unit 46 from the transport system 32 and providing the gripper unit 46 to the transport system 32 of the feeder unit 20.

Thus, the platen press unit 22 in total comprises four handover mechanisms 47*r*, 47*d*.

The same applies to the stripping unit 24 to which the above explanations apply mutatis mutandis.

The shared transport system 32 of the quality control unit 26 and the delivery unit 28 comprises a handover mechanism 47*r* being provided in the transition zone 48 associated with its input end 26*i* and being configured for receiving the gripper unit 46 carrying a sheet 12 from the stripping unit 24 and coupling the received gripper unit 46 to its transport system 32.

Furthermore, a handover mechanism 47*d* is provided in the transition zone 50 associated with its input end 26*i* and being configured for decoupling the gripper unit 46 from the transport system 32 and providing the gripper unit 46 to the transport system 32 of the stripping unit 22.

Thus, the combination of the quality control unit 26 and the delivery unit 28 in total comprises two handover mechanisms 47*d*, 47*r*.

A sheet material processing machine 10 according to a third embodiment is shown in FIG. 3.

In the following, only the differences to the sheet material processing machines according to the first and second embodiments will be explained. Equal or corresponding parts will be designated with the same reference signs.

The sheet material processing machine 10 according to the third embodiment is a hot-foil stamping machine. The platen press unit 22 is adapted accordingly.

In contrast to the embodiments explained above, it comprises a foil handling system 52 with a storage facility for foils to be processed by the platen press unit 22.

The foil handling system 52 is arranged inside the shared transport system 32 of the quality control unit 26 and the delivery unit 28.

Furthermore, the stripping unit 24 has been eliminated.

Figure 5:
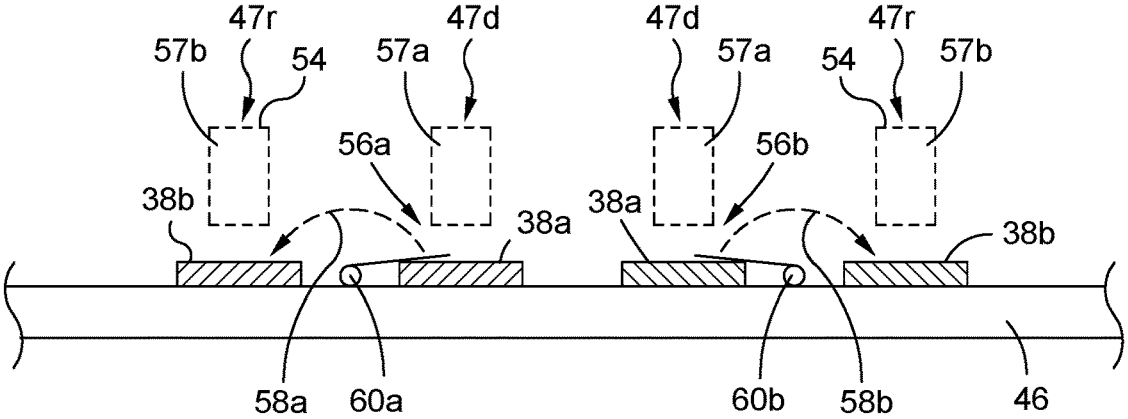
Figure 6:
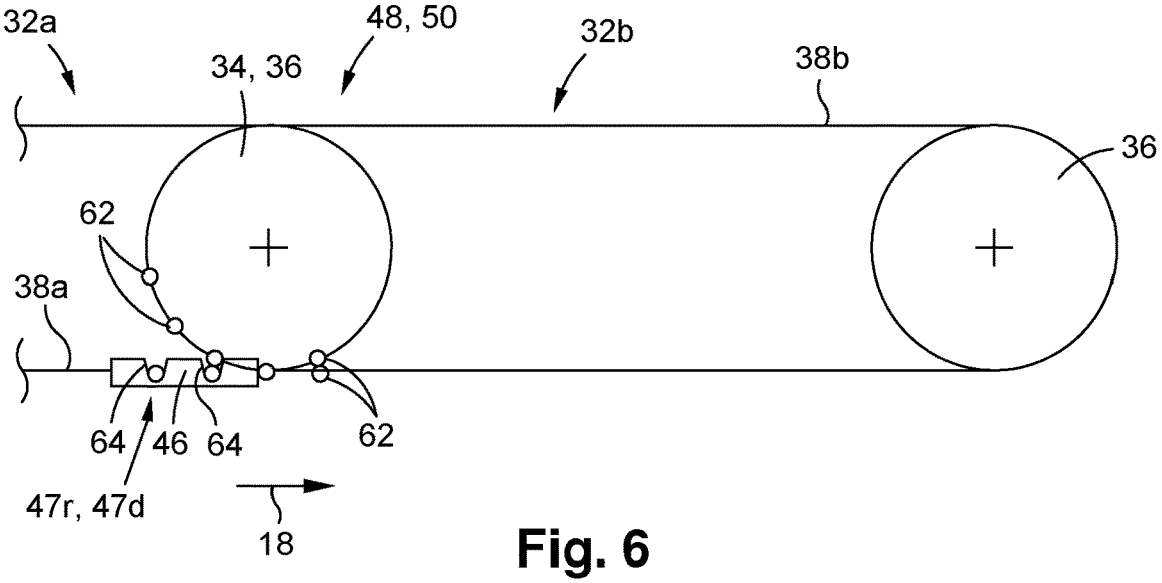

FIGS. 4 and 5 show the transition zones 48, 50 and the corresponding handover mechanisms 47*r*, 47*d*.

In this context, two belts 38 of a first transport system 32 and two belts 38 of a second transport system 32 are shown.

In order to differentiate the two transport systems 32, elements of the first transport system will be designated with a suffix a and elements of the second transport system will be designated with a suffix b.

The first transport system 32*a* is for example associated to the feeder unit 20, the platen press unit 22 or the stripping unit 24.

The second transport system 32*b* is for example associated to the platen press unit 22 or the stripping unit 24.

Along the processing direction 18 the second transport system 32*b* is arranged behind the first transport system 32*a*. Additionally, the first transport system 32*a* overlaps the second transport system 32*b* in the processing direction 18.

In the state represented in FIGS. 4 and 5 the gripper unit 46 is coupled to the first transport system 32*a*, more precisely to the corresponding belts 38*a* via a clamping mechanism 54.

It comprises at least two clamps 56*a*, 56*b*. They engage the belts 38*a* in that the belts 38*a* are clamped between the respective clamps 56*a*, 56*b* and the gripping unit 46.

In order to transfer the gripping unit 46 from the first transport system 32*a* to the second transport system 32*b* the clamps 56*a*, 56*b* are disengaged from the belts 38*a*. To this end the handover mechanism 47*d* is be used, which decouples the gripper unit 46 from the first transport system 32 and provides it to the second transport system 32*b*.

The handover mechanism 47*d* is associated with actor 57*a*, which may interact with the clamps 56*a*, 56*b* via cams or cammed wheels.

Subsequently, the handover mechanism 47*r* which is associated with the second transport system 32*b* receives the gripper unit 46 and couples it to the second transport system 32*b* in that the belts 38*b* are clamped between the respective clamps 56*a*, 56*b* and the gripping unit 46.

Also the handover mechanism 47*r* is associated with an actor 57*b*, which may interact with the clamps 56*a*, 56*b* via cams or cammed wheels.

This handover procedure is illustrated by arrows 58*a*, 58*b*. Respective turning axes of the clamps 56*a*, 56*b* are designated by reference signs 60*a*, 60*b*.

Transition zones 48, 50 with alternative handover mechanisms 47*d*, 47*r* are shown in FIG. 6.

In this alternative the first transport wheel 34 and the second transport wheel 36 of neighboring transport systems 32 are substantially arranged coaxially.

Both a belt 38*a* of a first transport system 32*a* and a belt 38*b* of a second transport system 32*b* are equipped with male clip elements 62. For the ease of representation only some of the male clip elements 62 are provided with a reference sign.

The gripper unit 46 to be transferred from the first transport system 32*a* to the second transport system 32*b* comprises female clip elements 64.

In the state represented in FIG. 6 the male clip elements 62 of the first belt 38*a* are engaged with the female clip elements 64 of the gripper unit 46 thereby forming a clip-on mechanism 66.

When travelling further in the processing direction 18 the male clip elements 62 of the first belt 38*a* will be disengaged from the gripper unit 46 by the handover mechanism 47*d*.

Subsequently, the gripper unit 46 will be transferred to the second transport system 32*b* and the gripper unit 46, more precisely the female clip elements 64 provided thereon, will be engaged with the male clip elements 62 of the second belt 38*b* by the handover mechanism 47*r*.

Figure 7:
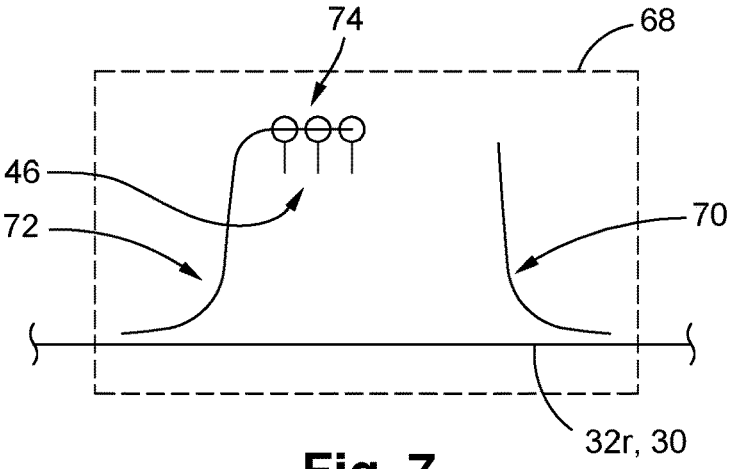

FIG. 7 shows a gripper exchange module 68 which may be coupled to a recirculation section 32*r* of any one of the previously described sheet material processing units 20 to 28 or a recirculation unit 30.

The gripper exchange module 68 comprises a gripper withdrawal section 70 which is configured for withdrawing gripper units 46 from the recirculation section 32*r* or the recirculation unit 30.

Moreover, the gripper exchange module 68 has a feeder section 72 which is configured for feeding gripper units 46 to the recirculation section 32*r* or the recirculation unit 30.

The feeder section 72 is equipped with an input buffer 74, where for the ease of representation three gripper units 46 are stored.

The gripper exchange module 68 may be used for exchanging gripper units 46 needing replacement.

Moreover, the gripper exchange module 68 is configured for adapting a number of gripper units 46 being used in the sheet material processing machine 10 and, thus, for adapting the sheet material processing machine 10 to different jobs needing different numbers of gripper units 46.

Figure 8:
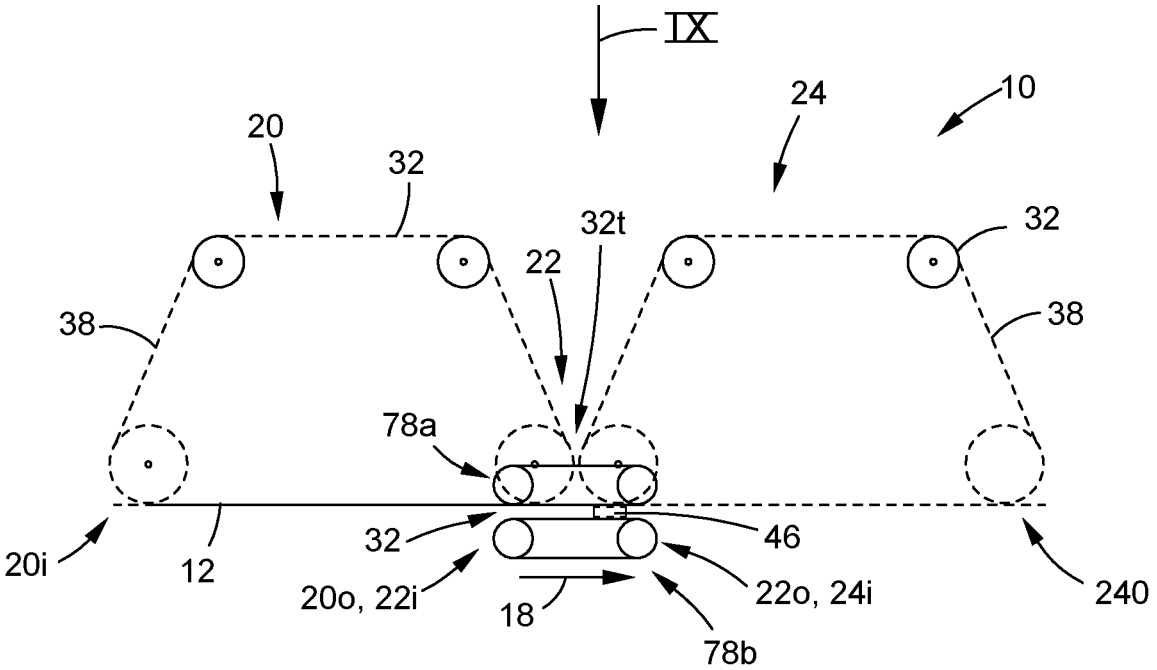
Figure 9:
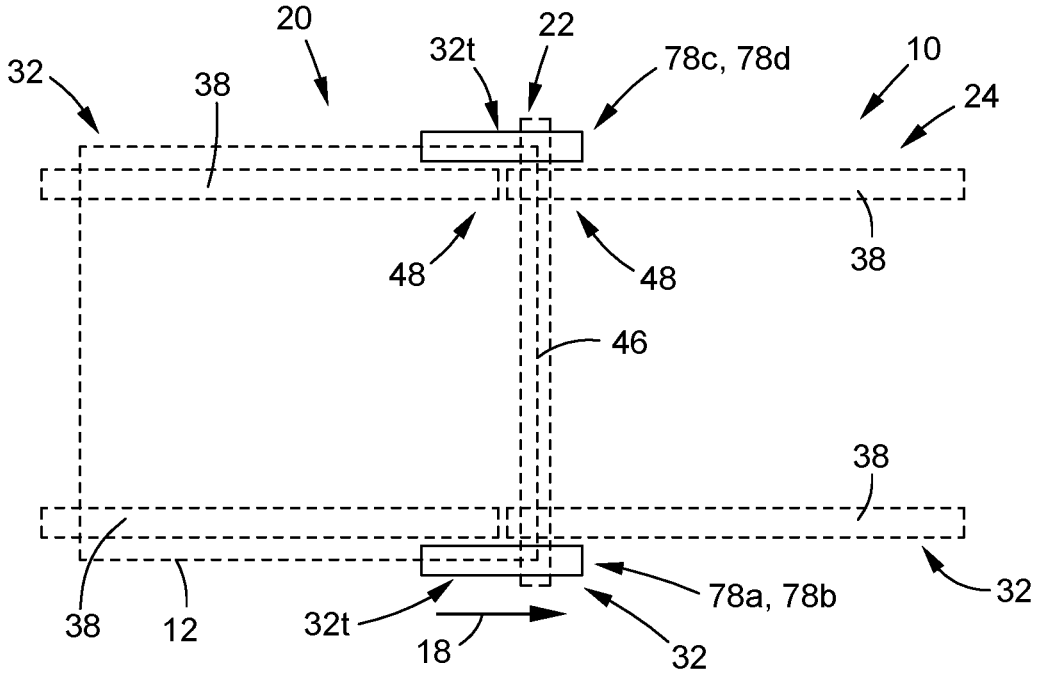

FIGS. 8 and 9 show a sheet material processing machine 10 according to a fourth embodiment.

Again, only the differences to the sheet material processing machines 10 according to the embodiment described above will be explained. Corresponding parts will be designated with the same reference signs.

The sheet material processing machine 10 of the fourth embodiment comprises three sheet material processing units 20, 22, 24, wherein the sheet material processing units 20 and 24 are configured for performing a process step on the sheet 12 to be processed. They may be of any type mentioned in the previous embodiments.

Sheet material processing unit 22 is a transition unit 76 and thus is configured for connecting the sheet material processing units 20, 24 in terms of material flow, i.e. as far as a flow of sheets 12 to be processed is concerned.

The transport system 32 of the transition unit 76 comprises a transition section 32*t* configured for transporting gripper units 46 holding sheets 12 or parts thereof in a direction from the input end 22*i* to the output end 22*o* of the transition unit 76.

The transition section 32*t* is associated with a handover mechanism arranged on the input end 22*i* and being configured for receiving a gripper unit 46 from sheet material processing unit 20 and coupling the received gripper unit 46 to the transport system 32 of the transition unit 76.

Furthermore, the transition section 32*t* is associated with a handover mechanism arranged on the output end 22*o* and being configured for decoupling the gripper unit 46 from the transport system 32 of the transition unit 76 and providing it to sheet material processing unit 24.

Both handover mechanisms are configured as in the previous embodiments. For the ease of representation they are not shown in FIGS. 8 and 9.

The transports system 32 of the transition unit 76 comprises four belt drives 78*a*, 78*b*, 78*c*, 78*d*.

Belt drives 78*a*, 78*b* are positioned on the same side of the sheet material processing machine 10 and are arranged one above the other such that a gripper unit 46 may be received between belt drives 78*a*, 78*b*.

Similarly, belt drives 78*c*, 78*d* are positioned on a side of the sheet material processing machine 10 which is opposed to the side where belt drives 78*a*, 78*b* are located. Also belt drives 78*c*, 78*d* are arranged one above the other such that a gripper unit 46 may be received belt drives 78*c*, 78*d*.

During the operation of the sheet material processing machine 10 a gripper unit 46 being provided by the handover mechanism at the output end 20*o* of the sheet material processing unit 20 may be received by the transport system 32 of the transition unit 76, i.e. between belt drives 78*a*, 78*b* and belt drives 78*c*, 78*d*.

Upon actuation of the belt drives 78*a* to 78*d*, the gripper unit 46 and a sheet 12 connected therewith may be transported from the input end 22*i* to the output end 22*o* of the transition unit 76.

At the output end 22*o* the gripper unit 46 and the sheet 12 may be provided to a handover mechanism at the input end 24*i* of the sheet material processing unit 24.

As can for example be seen when comparing the sheet material processing machine 10 of the fourth embodiment to the transition zone 48 shown in FIG. 4, the transition unit 76 renders sheet material processing units 20, 24 compatible which both comprise transport systems 32 wherein belts 38 are arranged with substantially equal transversal distance. In this configuration it is not possible to arrange the belts 38 in an overlapping manner with respect to the processing direction 18.

For recirculating gripper units in a direction opposed to the processing direction 18 either a recirculation module 30 may be provided or the sheet material processing units 20, 22, 24 may be equipped with recirculation section as has already been described before.

The invention claimed is:

1. A sheet material processing machine, comprising:

at least two neighboring sheet material processing units, each sheet material processing unit including:

an input end where sheets to be processed enter the sheet material processing unit, and an output end where at least parts of the sheets leave the sheet material processing unit, a transport system for transporting the sheets or parts thereof from the input end to the output end, and a gripper unit releasably coupled to the transport system and configured for holding at least a part of one of the sheets, wherein the input end and/or the output end are/is equipped with a handover mechanism configured for decoupling the gripper unit from the transport system and providing the gripper unit to a neighboring sheet material processing unit and/or receiving a gripper unit from a neighboring sheet material processing unit and coupling the received gripper unit to a corresponding transport system; and a recirculation module comprising a transport system for transferring gripper units from an output end of a second sheet material processing unit of the at least two neighboring sheet material processing units to an input end of a first sheet material processing unit of the at least two neighboring sheet material processing units, wherein the at least two neighboring sheet material processing units are coupled by a first handover mechanism provided at an output end of the first sheet material processing unit and configured for decoupling the gripper unit from the corresponding transport system and providing the gripper unit to the second sheet material processing unit, and a second handover mechanism provided at an input end of the second sheet material processing unit and configured for receiving the gripper unit from the first sheet material processing unit and coupling the received gripper unit to a corresponding transport system.

2. The sheet material processing machine according to claim 1, wherein the gripper unit is coupled to the transport system via a clip-on mechanism or via a clamping mechanism.

3. The sheet material processing machine according to claim 2, wherein the gripper unit is coupled to the transport system via the clip-on mechanism, and wherein the transport system comprises one or more male clip elements and the gripper unit comprises one or more corresponding female clip elements.

4. The sheet material processing machine according to claim 1, wherein the gripper unit is coupled to the transport system via a clamping mechanism, wherein the gripper unit comprises at least one switchable clamp configured for selectively engaging the transport system of one of the at least two neighboring sheet material processing units and/or the transport system of another one of the at least two neighboring sheet material processing units.

5. The sheet material processing machine according to claim 1, wherein the transport system comprises a processing section configured for transporting gripper units holding sheets or parts thereof for being processed in a direction from the input end to the output end, wherein the processing section is associated with a handover mechanism arranged on the input end and configured for receiving a gripper unit from one of the at least two neighboring sheet material processing units and coupling the received gripper unit to the corresponding transport system, and/or wherein the processing section is associated with a handover mechanism arranged on the output end and configured for decoupling the gripper unit from the transport system and providing the gripper unit to another of the at least two neighboring sheet material processing units.

6. The sheet material processing machine according to claim 1, wherein the sheet material processing unit is a feeder unit, including a registration module, a platen press unit, a hot foil stamping unit or a die-cutting unit, a stripping unit, a quality control unit, a digital printing unit, a digital embellishment unit, a digital cutting unit, a creasing unit, or a delivery unit.

7. The sheet material processing machine unit according to claim 1, wherein the transport system comprises a recirculation section configured for transporting gripper units without sheets in a direction from the output end to the input end, wherein the recirculation section is associated with a handover mechanism arranged on the output end and configured for receiving a gripper unit from one of the at least two neighboring sheet material processing units and coupling the received gripper unit to the corresponding transport system, and/or wherein the recirculation section is associated with a handover mechanism arranged on the input end and configured for decoupling the gripper unit from the transport system and providing the gripper unit to another of the at least two neighboring sheet material processing units.

8. The sheet material processing machine according to claim 1, wherein the transport system comprises a belt drive or a chain drive, wherein the gripper unit is releasably coupled to a corresponding belt or chain.

9. The sheet material processing machine according to claim 1, further comprising:

a gripper exchange module coupled to a recirculation section of at least one of the at least two sheet material processing units or the recirculation module, and configured for withdrawing gripper units from the recirculation section or the recirculation module and/or for feeding gripper units into the recirculation section or the recirculation module.

10. The sheet material processing machine according to claim 1, wherein the transport system of the first sheet material processing unit overlaps the transport system of the second sheet material processing unit in a processing direction.

11. The sheet material processing machine according to claim 1, wherein the sheet material processing machine is a platen press, a hot-foil stamping machine, or a die-cutting machine.

12. The sheet material processing machine according to claim 5, wherein the sheet material processing unit is a transition unit configured for connecting two sheet material processing units, wherein the transport system comprises a transition section configured for transporting gripper units holding sheets or parts thereof in a direction from the input end to the output end, wherein the transition section is associated with a handover mechanism arranged on the input end and configured for receiving a gripper unit from a neighboring sheet material processing unit and coupling the received gripper unit to the corresponding transport system, and wherein the transition section is associated with a handover mechanism arranged on the output end and configured for decoupling the gripper unit from the transport system and providing the gripper unit to a neighboring sheet material processing unit.

13. A sheet material processing machine, comprising:

at least two neighboring sheet material processing units, each sheet material processing unit including:

an input end where sheets to be processed enter the sheet material processing unit, and an output end where at least parts of the sheets leave the sheet material processing unit, a transport system for transporting the sheets or parts thereof from the input end to the output end, and a gripper unit releasably coupled to the transport system and configured for holding at least a part of one of the sheets, wherein the input end and/or the output end are/is equipped with a handover mechanism configured for decoupling the gripper unit from the transport system and providing the gripper unit to one of the at least two neighboring sheet material processing units and/or receiving a gripper unit from another of the at least two neighboring sheet material processing units and coupling the received gripper unit to a corresponding transport system, wherein the at least two neighboring sheet material processing units are coupled by:

a first handover mechanism provided at an output end of a first sheet material processing unit of the at least two neighboring sheet material processing units and configured for decoupling the gripper unit from the corresponding transport system and providing the gripper unit to a second sheet material processing unit of the at least two neighboring sheet material processing units, a second handover mechanism provided at an input end of the second sheet material processing unit and configured for receiving the gripper unit from the first sheet material processing unit and coupling the received gripper unit to a corresponding transport system, a third handover mechanism provided at an input end of the second sheet material processing unit and configured for decoupling the gripper unit from the corresponding transport system and providing the gripper unit to the first sheet material processing unit, and a fourth handover mechanism provided at an output end of the first sheet material processing unit and configured for receiving the gripper unit from the second sheet material processing unit and coupling the received gripper unit to a corresponding transport system.

14. A sheet material processing machine, comprising:

at least two neighboring sheet material processing units, each sheet material processing unit including:

an input end where sheets to be processed enter the sheet material processing unit, and an output end where at least parts of the sheets leave the sheet material processing unit, a transport system for transporting the sheets or parts thereof from the input end to the output end, and a gripper unit releasably coupled to the transport system and configured for holding at least a part of one of the sheets, wherein the input end and/or the output end are/is equipped with a handover mechanism configured for decoupling the gripper unit from the transport system and providing the gripper unit to one of the at least two neighboring sheet material processing units and/or receiving a gripper unit from another of the at least two neighboring sheet material processing units and coupling the received gripper unit to a corresponding transport system, wherein the at least two neighboring sheet material processing units are coupled by a first handover mechanism provided at an output end of a first sheet material processing unit of the at least two neighboring sheet material processing units and configured for decoupling the gripper unit from the corresponding transport system and providing the gripper unit to a second sheet material processing unit of the at least two neighboring sheet material processing units, and a second handover mechanism provided at an input end of the second sheet material processing unit and configured for receiving the gripper unit from the first sheet material processing unit and coupling the received gripper unit to a corresponding transport system, wherein the transport system of the first sheet material processing unit of the at least two neighboring sheet material processing units comprises a first transport wheel arranged at the output end thereof, and the transport system of the second sheet material processing unit comprises a second transport wheel arranged at the input end thereof, and wherein the first transport wheel and the second transport wheel are substantially arranged coaxially.

* * * * *